US006402868B1

(12) United States Patent
Tagawa et al.

(10) Patent No.: US 6,402,868 B1
(45) Date of Patent: Jun. 11, 2002

(54) METHOD FOR FORMING A CONTINUOUS MATERIAL

(75) Inventors: Kimiteru Tagawa, Tokyo; Shigemoto Kijima, Kanagawa; Yoshitake Kobayashi; Eiji Ohtsubo, both of Aichi, all of (JP)

(73) Assignee: Mitsui Chemicals, Inc. (JP)

( * ) Notice: Subject to any disclaimer, the term of this patent is extended or adjusted under 35 U.S.C. 154(b) by 0 days.

(21) Appl. No.: 09/446,150

(22) PCT Filed: Jun. 4, 1998

(86) PCT No.: PCT/JP98/02472

§ 371 (c)(1),
(2), (4) Date: Dec. 17, 1999

(87) PCT Pub. No.: WO99/62803

PCT Pub. Date: Sep. 12, 1999

(51) Int. Cl.[7] ..... B65H 69/06; B31F 5/06

(52) U.S. Cl. ..... 156/157; 156/502; 156/504; 242/556

(58) Field of Search ..... 156/157, 502, 156/504, 583.1, 312; 242/551, 552, 556, 556.1

(56) References Cited

U.S. PATENT DOCUMENTS 4,211,594 A * 7/1980 Freitag et al. ..... 156/158
4,816,111 A 3/1989 Pittarello et al.
5,232,529 A * 8/1993 Miyake ..... 156/157 X
5,656,125 A * 8/1997 Tanaka ..... 156/157 X
5,902,431 A * 5/1999 Wilkinson et al. ..... 156/157
6,099,676 A * 8/2000 Hayashi ..... 156/312 X

FOREIGN PATENT DOCUMENTS

| | | |
|---|---|---|
| DE | 26 01 967 | 7/1977 |
| JP | 62-135584 | 6/1987 |
| JP | 4-106060 | 4/1992 |
| WO | 84/04486 | 11/1984 |

* cited by examiner

*Primary Examiner*—Mark A. Osele
(74) *Attorney, Agent, or Firm*—Burns, Doane, Swecker & Mathis, L.L.P.

(57) ABSTRACT

A method for forming a continuous material by connecting sheet materials which are used in various fields including the processing of metal foils, the processing of metal-plastic composite film material, and the processing of thermoplastic resin films such as polyimides, and an apparatus used for carrying out this method comprising a hot press, a material locking device and an accumulator. A continuous material can be formed by interposing a resin bonding layer between the trailing edge of a sheet material and the leading edge of another sheet material, and subjecting this part to thermo-compression bonding.

8 Claims, 2 Drawing Sheets

METHOD FOR FORMING A CONTINUOUS MATERIAL

DETAILED DESCRIPTION OF THE INVENTION

1. Technical Field of the Invention

This invention relates to a method for forming a continuous material by connecting sheet materials and an apparatus for forming a continuous material by connecting sheet materials which is used for carrying out the method. More particularly, it relates to a method for forming a continuous material by connecting sheet materials which are used in various fields including the processing of metal foils, the processing of metal-plastic composite film materials, and the processing of heat-resistant resin films such as polyimides and which require high-temperature processing in the range of 200° C. to less than 550° C. by means of coating and drying equipment, heat-treating equipment or the like, as well as an apparatus for forming a continuous material by connecting sheet materials which is used for carrying out the method.

2. Prior Art

Conventionally, ultrasonic welding has been employed as a method for connecting metal foils with each other. Moreover, connecting methods using or staples have been employed to connect heat-resistant plastics, such as polyimides, with each other.

Ultrasonic welding can be used to connect different metal foils, but cannot be used to connect heat-resistant plastics such as polyimides. On the other hand, the connecting method using a heat-resistant adhesive tape can be employed in a temperature range of less than 200° C., but shows a reduction in adhesion strength when it is employed at temperatures higher than 200° C. Consequently, the joint may be separated when a tension of 0.1 to 50 kgf/cm is applied to the material. Moreover, the connecting method using staples fails to give sufficient bonding strength when it is employed for thin metal foils, plastic films and other materials having a thickness of not greater than 18 mm. Consequently, this method is not satisfactory in that the material may be broken when a tension of 0.1 to 50 kgf/cm is applied thereto.

PROBLEM TO BE SOLVED BY THE INVENTION

In view of the above-described disadvantages of the prior art, an object of the present invention is to provide a method for forming a continuous material by connecting sheet materials wherein a metal foil and a heat-resistant plastic can be satisfactorily connected together, to say nothing of metal foils or heat-resistant plastics, and wherein the connected materials will not be separated even where they are processed at a temperature in the range of 200° C. to less than 550° C. and under a tension in the range of 0.1 to 50 kgf/cm, as well as an apparatus for forming a continuous material which is used for carrying out the aforesaid method.

MEANS FOR SOLVING THE PROBLEM

In order to solve the above-described problem, the present inventors made intensive investigations and have now found a method in which, using a connecting apparatus comprising a hot press, a material locking device and an accumulator, a continuous material can be formed by interposing a resin bonding layer between the trailing edge of a sheet material and the leading edge of another sheet material, and subjecting this part to thermocompression bonding. During thermocompression bonding, the material locking device is operated so that the part to be joined by thermocompression bonding comes to a standstill within the hot press, and the accumulator is also operated so that the feed speed of the sheet material on the downstream side is adjusted to a predetermined value. Thus, the completely connected sheet materials can be processed continuously. The present invention has been completed on the basis of these findings.

That is, the present invention provides a method for forming a continuous material by connecting a preceding sheet material with a succeeding other sheet material in end-to-end relationship while feeding them in their longitudinal direction, the method comprising the steps of:

(1) interposing a resin bonding layer 5 between the trailing edge of the preceding sheet material 4 and the leading edge of the succeeding other sheet material 6, and temporarily joining them together;

(2) after the preceding sheet material 4 and the succeeding other sheet material 6 are fed until the temporarily joined part reaches a hot press 1, operating a material locking device 2 to lock a part of the preceding sheet material 4 and thereby bring the temporarily joined part to a standstill within the hot press 1, and also operating an accumulator 3 to keep the feed speed of the preceding sheet material 4 constant on the downstream side thereof;

(3) operating the hot press 1 to effect thermocompression bonding of the temporarily joined part and thereby connect the preceding sheet material 4 with the succeeding other sheet material 6; and (4) releasing the preceding sheet material 4 from the lock by the material locking device 2 and feeding the connected sheet materials downstream through the accumulator 3.

Preferred embodiments of the above-described method for forming a continuous material by connecting sheet materials in accordance with the present invention include a method for forming a continuous material by connecting sheet materials as described above wherein the thermocompression bonding is performed at a temperature in the range of 200° C. to less than 550° C. and a pressure in the range of 0.001 to 50 kgf/cm$^2$; a method for forming a continuous material by connecting sheet materials as described above wherein the trailing edge of the preceding sheet material 4 and the leading edge of the succeeding other sheet material 6 each have a length of 10 to 1,000 mm; a method for forming a continuous material by connecting sheet materials as described above wherein the preceding sheet material 4 and the succeeding other sheet material 6 each comprise a metal foil or heat-resistant resin film having a thickness of 5 to 500 $\mu$m; and a method for forming a continuous material by connecting sheet materials as described above wherein the resin bonding layer has a thickness of 0.1 to 50 $\mu$m. Each of the above-described methods for forming a continuous material by connecting sheet materials is preferably employed especially where the connected sheet materials are continuously processed at a temperature in the range of 200° C. to less than 550° C. and under a tension in the range of 0.1 to 50 kgf/cm.

In another aspect, the present invention also provides an apparatus for forming a continuous material by connecting sheet materials which is used for carrying out each of the above-described methods for forming a continuous material by connecting sheet materials, the apparatus comprising a hot press for effecting thermocompression bonding of a temporarily joined part formed by making the trailing edge of a preceding sheet material and the leading edge of a succeeding other sheet material overlap with a bonding layer interposed therebetween, and temporarily joining them together; a material locking device for locking a part of the preceding sheet material in order to bring the temporarily joined part to a standstill within the hot press; and an accumulator for keeping the traveling speed of the preceding material constant on the downstream side of the material locking device.

According to the present invention, even where a subsequent processing step is carried out under severe conditions including a temperature in the range of 200° C. to less than 550° C. and a tension in the range of 0.1 to 50 kgf/cm, sheet materials can be satisfactorily processed without suffering from breakage, separation, meandering, variation in tension, or the like. Moreover, by connecting sheet materials according to the present invention, they can be stably and efficiently connected with each other, and they can be fed to a subsequent step at a constant feed speed.

EMBODIMENTS OF THE INVENTION

The present invention is more specifically described hereinbelow.

An outline of the method for forming a continuous material by connecting sheet materials in accordance with the present invention is as follows. First of all, while a preceding sheet material is being fed by a feeding means, the trailing edge of the preceding sheet material and the leading edge of a succeeding other sheet material are made to overlap with a resin bonding layer interposed therebetween, and temporarily joined together by means of an adhesive tape or the like. The temporarily joined sheet materials are fed downstream by the feeding means. As soon as the temporarily joined part reaches a hot press, a part of the preceding sheet material is locked by means of a sheet material locking device, so that the temporarily joined part comes to a standstill within the hot press. At this time, an accumulator is operated to keep the feed speed of the preceding sheet material constant. Subsequently, the hot press is operated to effect thermocompression bonding of the temporarily joined part of the sheet materials having the resin bonding layer therebetween. After the connection of the sheet materials is completed, the material locking device unlocks the preceding sheet material, so that the sheet materials connected by the resulting joint travel toward the accumulator.

Now, one embodiment of the present invention is described below with reference to the accompanying drawings.

FIGS. 1 to 4 are given for the purpose of explaining the construction and operation of one form of apparatus used for carrying out the method for forming a continuous material by connecting sheet materials in accordance with the present invention. Specifically, FIG. 1 illustrates sheet materials having a resin bonding layer interposed therebetween. FIG. 2 illustrates the sheet materials whose joined part has come to a standstill within a hot press. FIG. 3 illustrates the sheet materials being subjected to thermocompression bonding by operating the hot press. FIG. 4 illustrates the completely connected sheet materials.

As illustrated in FIGS. 1 to 4, this form of apparatus includes a hot press 1 in order to connect the trailing edge of a preceding sheet material 4 being fed by a feeding means (not shown) and being processed, with the leading edge of a succeeding other sheet material 6 to be processed, by means of a resin bonding layer 5.

No particular limitation is placed on the type of the hot press 1. However, it is preferable to use a hot press having hot platens in which a heater and the like are incorporated. Although the heating temperature employed for thermocompression bonding may be chosen according to the type of the resin bonding layer, it is usually in the range of 200° C. to less than 550° C. and preferably in the range of 200 to 450° C. Although no particular limitation is placed on the pressure employed for hot pressing, it is preferably in the range of 0.001 to 50 kgf/cm$^2$ and more preferably in the range of 0.001 to 1 kgf/cm$^2$ so that a sufficient adhesion strength may be achieved and no damage may be caused to the sheet materials.

In order to transfer heat and pressure uniformly, it is preferable to cover the hot platens with heat-resistant rubber. Alternatively, it is also preferable to provide the hot platens with a raised pattern and thereby increase the applied pressure locally. No particular limitation is placed on the time required for hot pressing. However, from a practical point of view, it ranges from 0.1 second to 30 minutes, preferably from 0.5 second to 10 minutes, and more preferably from 1 second to 5 minutes. No particular limitation is placed on the length of the part in which the sheet materials are connected by thermocompression bonding. However, with consideration for the tension applied to the sheet material being processed in a subsequent step, and the like, it is usually in the range of about 10 to 1,000 mm and preferably in the range of 50 to 500 mm.

Moreover, this apparatus includes a material locking device 2 for stopping the movement of the trailing edge of the preceding sheet material 4 being processed, during bonding by the hot press 1; and an accumulator 3 for keeping the traveling speed of the preceding sheet material 4 being processed constant on the downstream side of the material locking device 2 (i.e., on the side of the material locking device 2 which is opposite to the hot press 1).

The material locking device 2 preferably consists of a pair of rolls which can be engaged with each other to pinch and lock the sheet material. The accumulator 3 preferably consists of a plurality of rolls arranged in such a way that the length of the sheet material wound around the rolls is regulated, for example, by shifting the opposed rolls in a direction orthogonal to the feed direction of the sheet material, whereby the traveling speed of the sheet material 4 being processed can be kept constant even when it is locked by the material locking device 2.

The sheet materials which can be used as the sheet materials 4 and 6 include metal foils such as copper foil, stainless foil, aluminum foil, Ni—Fe alloy foil, and copper-based alloy foil; heat-resistant plastic films such as polyimides, polyamides, arainids and liquid crystal polymers; and composite films composed of metal foils and heat-resistant plastics. The thickness of the sheet materials is preferably in the range of about 5 to 500 $\mu$m, more preferably about 5 to 100 $\mu$m, and most preferably about 5 to 50 $\mu$m.

The resin bonding layer 5 used as the bonding layer may comprise any resin layer characterized by thermoplasticity. A non-thermoplastic polyimide film, a metal foil as described above, and other films having a resin boding layer formed on either side thereof may also be used. In any case, the resin bonding layer constituting the bonding layer has a thickness of about 0.1 to 100 $\mu$m.

A thermoplastic resin preferably having a glass transition temperature of 150 to 350° C. is used for the resin bonding layer, and examples thereof include thermoplastic polyimides, aromatic polyamide-imides, aromatic polyetherimides and silicone-modified polyimides. Especially preferred are thermoplastic polyimides.

As the thermoplastic polyimide forming the thermoplastic polyimide film used as the bonding layer, there may be used well-known thermoplastic polyimides synthesized from a diamine and a tetracarboxylic acid dianhydride. More specifically, the diamine may preferably comprise at least one diamine selected from 1,3-bis(3-aminophenoxy) benzene, 4,4'-bis(3-aminophenoxy)biphenyl and 3,3'-diaminobenzophenone.

The tetracarboxylic acid dianhydride may preferably comprise at least one tetracarboxylic acid dianhydride selected from 3,3',4,4'-(diphenyl ether)tetracarboxylic acid dianhydride, 3,3',4,4'-benzophenonetetracarboxylic acid dianhydride, pyromellitic acid dianhydride and 3,3',4,4'-biphenyltetracarboxylic acid dianhydride.

The thermoplastic polyimide film used in the present invention preferably comprises a film of a polycondensation polymer prepared from at least one diamine component selected from the above-enumerated diamines and at least one tetracarboxylic acid dianhydride component selected from the above-enumerated tetracarboxylic acid dianhydrides. The molar ratio in which the diamine components is reacted with the tetracarboxylic acid dianhydride component is usually such that the amount of tetracarboxylic acid dianhydride component used is in the range of 0.75 to 1.25 moles per mole of the diamine component. Preferably, the amount of tetracarboxylic acid dianhydride component used is in the range of 0.8 to 1.2 moles.

A portion of the aforesaid diamine may be replaced by other diamines. The amine compounds which can be used for substitutional purposes include, for example, m-phenylenediamine, o-phenylenediamine, p-phenylenediamine, m-aminobenzylamine, p-aminobenzylamine, bis(3-aminophenyl) sulfide, (3-aminophenyl) (4-aminophenyl) sulfide, bis(4-aminophenyl) sulfide, bis(3-aminophenyl) sulfoxide, (3-aminophenyl) (4-aminophenyl) sulfoxide, bis(3-aminophenyl) sulfone, (3-aminophenyl) (4-aminophenyl) sulfone, bis(4-aminophenyl) sulfone, 3,4'-diaminobenzophenone, 4,4'-diaminobenzophenone, 3,3'-diaminodiphenylmethane, 3,4'-diaminodiphenylmethane, 4,4'-diaminodiphenylmethane, 4,4'-diaminodiphenyl ether, 3,3'-diaminodiphenyl ether, 3,4'-diaminodiphenyl ether, bis[4-(3-aminophenoxy)phenyl]methane, bis[4-(4-aminopheoxy)phenyl]methane, 1,1-bis[4-(3-aminophenoxy)phenyl]ethane, 1,1-bis[4-(4-aminophenoxy) phenyl]ethane, 1,2-bis[4-(3-aminophenoxy)phenyl]ethane, 1,2-bis[4-(4-aminophenoxy)phenyl]ethane, 2,2-bis[4-(3-aminophenoxy)phenyl]propane, 2,2-bis[4-(4-aminophenoxy)phenyl]propane, 2,2-bis[4-(3-aminophenoxy)phenyl]butane, 2,2-bis[3-(3-aminophenoxy) phenyl]-1,1,1,3,3,3-hexafluoropropane, 2,2-bis[4-(4-aminophenoxy)phenyl]-1,1,1,3,3,3-hexafluoropropane, 1,3-bis(3-aminophenoxy)benzene, 1,4-bis(3-aminophenoxy) benzene, 1,4'-bis(4-aminophenoxy)benzene, 4,4'-bis(4-aminophenoxy)biphenyl, bis[4-(3-aminophenoxy)phenyl] ketone, bis[4-(4-aminophenoxy)phenyl] ketone, bis[4-(3-aminophenoxy)phenyl] sulfide, bis[4-(4-aminophenoxy) phenyl] sulfide, bis[4-(3-aminophenoxy)phenyl] sulfoxide, bis[4-(aminophenoxy)phenyl] sulfoxide, bis[4-(3-aminophenoxy)phenyl] sulfone, bis[4-(4-aminophenoxy) phenyl] sulfone, bis[4-(3-aminophenoxy)phenyl] ether, bis[4-(4-aminophenoxy)phenyl] ether, 1,4-bis[4-(3-aminophenoxy)benzoyl]benzene, 1,3-bis[4-(3-aminophenoxy)benzoyl]benzene, 4,4'-bis[3-(4-aminophenoxy)benzoyl]diphenyl ether, 4,4'-bis[3-(3-aminophenoxy)benzoyl]diphenyl ether, 4,4'-bis[4-(4-amino-α, α-dimethylbenzyl)phenoxy]benzophenone, 4,4'-bis[4-(4-amino-α,α-dimethylbenzyl)phenoxy]diphenyl sulfone, bis[(4-{4-(4-aminophenoxy}phenoxyphenyl] sulfone, 1,4-bis[4-(4-aminophenoxy)-α,α-dimethylbenzyl]benzene and 1,3-bis[4-(4-aminophenoxy)-α,α-dimethylbenzyl] benzene.

These amine compounds may be used alone or in admixture of two or more. The proportion of the aforesaid specific diamine which may be replaced by other amine compounds is usually in the range of 0 to 50 mole % of the diamine.

The aforesaid tetracarboxylic acid dianhydride may be used in combination with other tetracarboxylic acid dianhydrides. The tetracarboxylic acid dianhydrides which can be used for this purpose include, for example, ethylenetetracarboxylic acid dianhydride, butanetetracarboxylic acid dianhydride, cyclopentanecarboxylic acid dianhydride, pyromellitic acid dianhydride, 2,2',3,3'-benzophenonetetracarboxylic acid dianhydride, 2,2',3,3'-biphenyltetracarboxylic acid dianhydride, 2,2-bis(3,4-dicarboxyphenyl)propane dianhydride, bis(3,4-dicarboxyphenyl) ether dianhydride, bis(2,3-dicarboxyphenyl) ether dianhydride, bis(3,4-dicarboxyphenyl) sulfone dianhydride, 1,1-bis(2,3-dicarboxyphenyl)methane dianhydride, bis(3,4-dicarboxyphenyl)methane dianhydride, 4,4'-(p-phenylenedioxy)diphthalic acid dianhydride, 4,4'-(m-phenylenedioxy)diphthalic acid dianhydride, 2,3,6,7-naphthalenetetracarboxylic acid dianhydride, 1,4,5,8-naphthalenetetracarboxylic acid dianhydride, 1,2,3,4-benzenetetracarboxylic acid dianhydride, 3,4,9,10-perylenetetracarboxylic acid dianhydride, 2,3,6,7-anthracenetetracarboxylic acid dianhydride and 1,2,7,8-phenanthrenetetracarboxylic acid dianhydride.

These tetracarboxylic acid dianhydrides may be used alone or in admixture of two or more. The proportion of the aforesaid specific tetracarboxylic acid dianhydride which may be replaced is usually in the range of 0 to 50 mole % of the tetracarboxylic acid dianhydride.

In the present invention, a dicarboxylic acid anhydride may be added in order to cap the chain ends of the thermoplastic polyimide used as a raw material for the formation of a thermoplastic polyimide film. The dicarboxylic acid anhydrides which can be used for this purpose include phthalic anhydride, 2,3-benzophenonedicarboxylic acid anhydride, 3,4-benzophenonedicarboxylic acid anhydride, 2,3-dicarboxyphenyl phenyl ether anhydride, 2,3-biphenyldicarboxylic acid anhydride, 3,4-biphenyldicarboxylic acid anhydride, 2,3-dicarboxyphenyl phenyl sulfone anhydride, 3,4-dicarboxyphenyl phenyl sulfone anhydride, 2,3-dicarboxyphenyl phenyl sulfide anhydride, 1,2-naphthalenedicarboxylic acid anhydride, 2,3-naphthalenedicarboxylic acid anhydride, 1,8-naphthalenedicarboxylic acid anhydride, 1,2-anthracenedicarboxylic acid anhydride, 2,3-anthracenedicarboxylic acid anhydride and 1,9-anthracenedicarboxylic acid anhydride.

These dicarboxylic acid anhydrides may be substituted by groups having no reactivity with amines or dicarboxylic acid anhydrides. The amount of dicarboxylic acid anhydride added is usually in the range of 0.001 to 0.5 mole per 100 moles of the combined amount of the aforesaid specific diamine and tetracarboxylic acid anhydride used as chief raw materials. Preferably, it is in the range of 0.005 to 0.25 mole.

Similarly, a monoamine may be added in order to cap the chain ends of the thermoplastic polyimide. The monoamines which can be used for this purpose include aniline, o-toluidine, m-toluidine, p-toluidine, 2,3-xylidine, 2,4-xylidine, 2,5-xylidine, 2,6-xylidine, 3,4-xylidine, 3,5-xylidine, o-chloroaniline, m-chloroaniline, p-chloroaniline, o-nitroaniline, o-bromoaniline, m-bromoaniline, o-nitroaniline, in-nitroaniline, p-nitroaniline, o-aminophenol, m-aminophenol, p-aminophenol, o-anisidine, m-anisidine, p-anisidine, o-phenetidine, m-phenetidine, p-phenetidine, o-aminobenzaldehyde, m-aminobenzaldehyde, p-aminobenzaldehyde, o-aminobenzonitrile, m-aminobenzonitrile, p-aminobenzonitrile, 2-aminobiphenyl, 3-aminobiphenyl, 4-aminobiphenyl, 2-aminophenol phenyl ether, 3-aminophenol phenyl ether, 4-aminophenol phenyl ether, 2-aminobenzophenone, 3-aminobenzophenone, 4-aminobenzophenone, 2-aminophenol phenyl sulfide, 3-aminophenol phenyl sulfide, 4-aminophenol phenyl sulfide, 2-aminophenol phenyl sulfone, 3-aminophenol phenyl sulfone, 4-aminophenol phenyl sulfone, α-naphthylamine, β-naphthylamine, 1-amino-2-naphthol, 2-amino-1-naphthol, 4-amino-1-naphthol, 5-amino-1-naphthol, 2-amino-1-naphthol, 5-amino-2-naphthol, 7-amino-2-naphthol, 8-amino-2-naphthol, 1-aminoanthracene, 2-aminoanthracene and 9-aminoanthracene.

These monoamines may be used alone or in admixture of two or more. The amount of monoamine added is usually in the range of 0.001 to 0.5 mole per 100 moles of the combined amount of the aforesaid specific diamine and tetracarboxylic acid anhydride used as chief raw materials. Preferably, it is in the range of 0.005 to 0.25 mole.

Beside the above-described thermoplastic polymides, aromatic polyetherimides, aromatic polyamide-imides, silicone-modified polyimides and the like may also be used for the resin bonding layer in the method of the present invention.

Aromatic polyetherimides are polymers having ether linkages and imide linkages as essential bonding units, and consist essentially of repeating units of the following general formula (1).

(1)

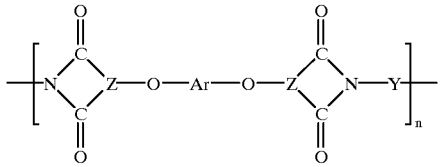

In the above formula, Z is a trifunctional aromatic group in which two of the three functional groups are attached to the adjacent carbon atoms, and Ar is a divalent aromatic reside. Specific examples of the repeating units includes those represented by the following formulae (2) to (8).

(2)

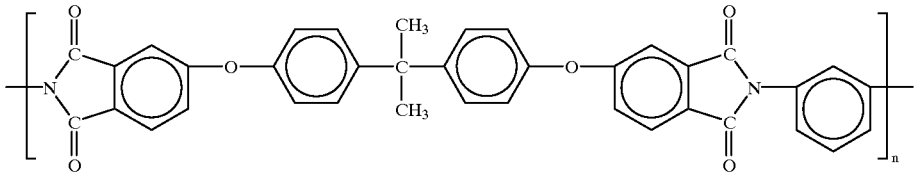

(3)

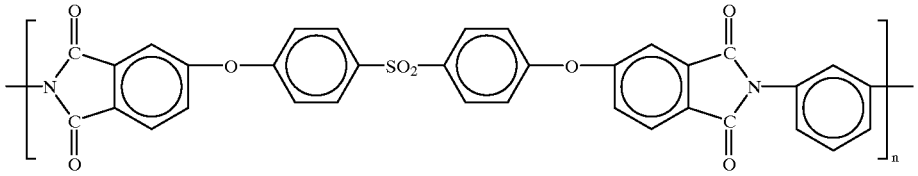

(4)

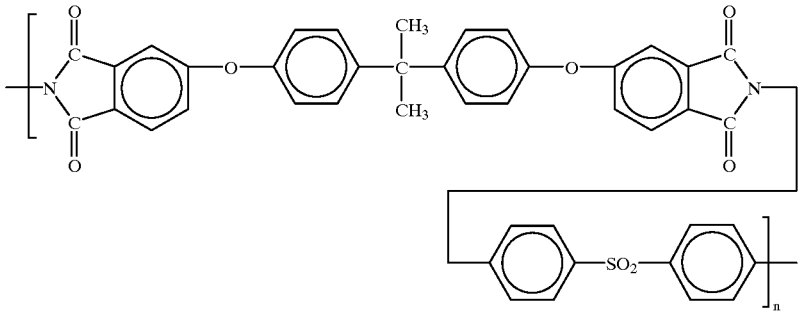

-continued
(5)
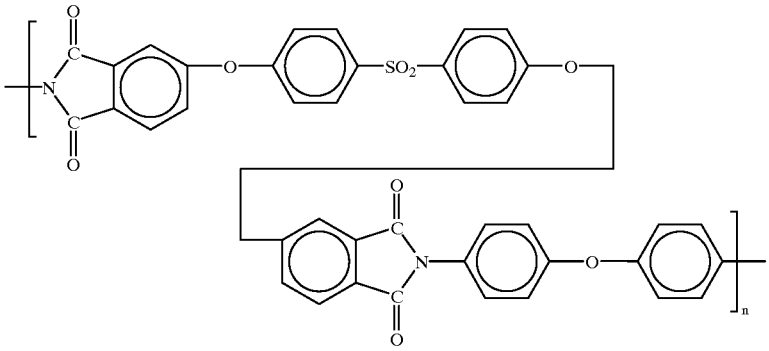
(6)
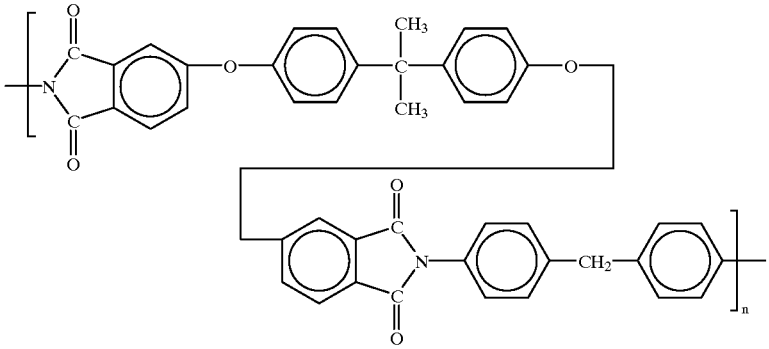
(7)
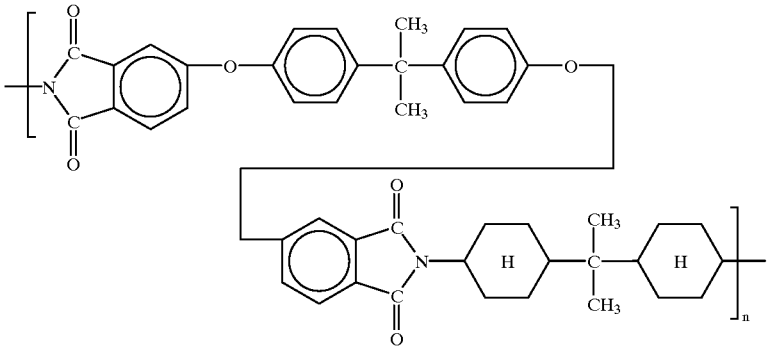
(8)
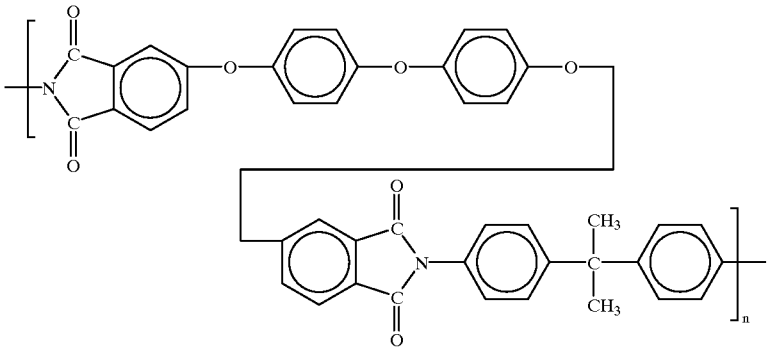

These aromatic polyetherimides are commercially available from General Electric Company, U.S.A., under the trade names of Ultein-1000, Ultem-4000, Ultem-6000 and the like.

Aromatic polyamide-imides are polymers having imide and amide linkages in the repeating units of the main chain, and consist of repeating units represented b the following general formula (9).

(9)

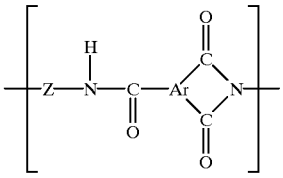

wherein Ar is a trivalent aromatic group containing at least one benzene ring, and Z is a divalent organic group.

The especially preferred aromatic polyamide-imides which can be used in the present invention are aromatic polyamide-imides having repeating units represented by the following general formula (10) or (11).

(10)

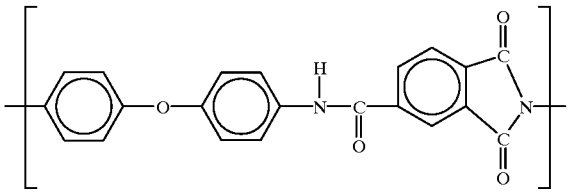

(11)

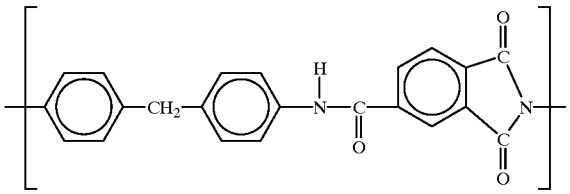

These aromatic polyamide-imides are commercially available from AMOCO, U.S.A., under the trade name of TORLON.

The silicone-modified polyimides which can be used in the method of the present invention are polycondensation polymers prepared from a diamine containing a siliconediamine as an essential component, and a tetracarboxylic acid dianhydride. Typical siliconediamines are α, ω-bisaminopolydimethylsiloxanes of the following general formula (12).

(12)

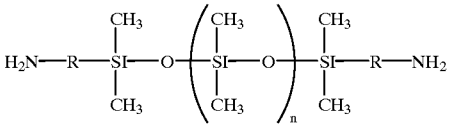

In formula (12), n preferably has a value of 0 to 10. It is especially preferable to use a polymer in which n is 4 to 10, or a mixture of such a polymer and a monomer in which n is 0.

The siliconediamine content in the total amine is preferably in the range of 5 to 15 mole %. At siliconediamine contents of 5 mole % or greater, the resulting polymer desirably has low water-absorbing properties. At siliconediamine contents of 50 mole % or less, the resulting polymer desirably has a high glass transition temperature and hence good heat resistance. The diamines other than siliconediamines, which can be used for the preparation of silicone-modified polyimides, include the same diamines as can be used as raw materials for the preparation of thermoplastic polyimides. The tetracarboxylic acid dianhydrides which can be used for this purpose include those described previously.

Now, the operation of this form of apparatus for connecting sheet materials is explained with reference to FIGS. 1 to 4. First of all, as illustrated in FIG. 1, a preceding sheet material 4 being processed is fed through a hot press 1 by a feeding means (not shown). Before passing through the hot press 1, the trailing edge of the preceding sheet material 4 and the leading edge of a succeeding other sheet material 6 to be processed are made to overlap with a resin bonding layer 5 interposed therebetween, and temporarily joined together by means of an adhesive tape 7. This adhesive tape 7 may comprise a commercially available double-coated adhesive tape. In this step, tile hot press 1, a material locking device 2 and an accumulator 3 are not operated.

Next, as illustrated in FIG. 2, the trailing edge of the sheet material 4 and the leading edge of the sheet material 6 are fed in the temporarily joined state. As soon as the temporarily joined part reaches the hot press 1, a part of the sheet material 4 being processed is locked by means of a material locking device 2 installed between the hot press 1 and an accumulator 3, so that the temporarily joined part comes to a standstill within the hot press 1. At this time, the accumulator 3 is operated to keep the traveling rate of the sheet material 4 being processed constant.

Moreover, as illustrated in FIG. 3, the hot press 1 is operated to effect thermocompression bonding of the trailing edge of the sheet material 4 and the leading edge of the sheet material 6 with the resin bonding layer 5 interposed therebetween.

After the connection of the sheet materials 4 and 6 by thermocompression bonding is completed, the sheet material 4 is released from the lock by the material locking device 2. Thus, as illustrated in FIG. 4, the joint between the sheet materials 4 and 6 travels toward accumulator 3.

As described above, the method and apparatus of this embodiment can connect the sheet materials 4 and 6 stably and efficiently to form a continuous material. the connected sheet materials 4 and 6 are processed in a subsequent step using coating and drying equipment, heat-treating equipment, or other equipment, where it is exposed to a high temperature in the range of 200° C. to less than 550° C. and a tension in the range of 0.1 to 50 kgf/cm. Even under such severe processing conditions, the connected sheet materials can be satisfactorily processed without suffering from any trouble such as breakage, meanderings or variation in tension.

EXAMPLES

Several embodiments of the present invention are more specifically explained with reference to the following examples.

Example 1

In Example 1, there was employed a feeder for feeding sheet materials continuously to a drying furnace having a temperature of 300° C. The sheet material being fed was copper foil and its thickness was 18 μm. The sheet material to be processed next time was a polyimide film and its thickness was 13 μm.

After the feeding of the copper foil was finished and before the feeding of the polyimide film was started, the trailing edge of the copper foil and the leading edge of the polyimide film was made to overlap (with a length of overlap of 300 mm) and joined with a double-coated adhesive tape. At the same time, a resin bonding layer comprising a thermoplastic polyimide film was interposed therebetween. As the thermoplastic polyimide film, there was used a polyimide film [manufactured by Kaneka Corp. under the trade name of Apical; having a thickness of 25 μm] having thermoplastic polyimide layers (each having a thickness of 8 μm) on both sides thereof.

In order to prepare the aforesaid thermoplastic polyimide, polyamic acid varnish obtained by mixing 3,3',4,4'-benzophenonetetracarboxylic acid dianhydride with 1,3'-bis (3-aminophenoxy) benzene in dimethylacetamide at room temperature was used as a starting material. This polyamic acid was applied to the aforesaid polyimide film, dried and imidized to form a thermoplastic polyimide layer. The temperature used for this purpose was 300° C.

A material locking device was operated to bring the overlapping part to a standstill within a hot press. Using hot platens disposed on both sides, the overlapping part was pressed at a pressure of 0.1 kgf/cm$^2$ and a temperature of 300° C. for 30 seconds. Observation of the joint revealed that the sheet materials were satisfactorily joined together. The hot platens were provided with a raised pattern so that the pressure of the press is focused on the raised regions. The pressure calculated from the area of the raised regions was 1.0 kgf/cm$^2$.

Following the copper foil, the polyimide film was fed to the drying furnace having a temperature of 300° C. and processed therein. The tension applied to the sheet material being processed was 5 kgf/cm, indicating that a great tensile force was exerted thereon. However, the sheet material was satisfactorily processed without suffering from any trouble such as breakage, meandering, or variation in tension.

Example 2

In Example 2, the processing temperature was set at 250° C. and the same apparatus as in Example 1 was used. The sheet material being processed and the sheet material to be connected comprised a copper film and a polyimide film, respectively, which were similar to those used in Example 1. As the thermoplastic polyimide film, there was used a film manufactured by Mitsui Chemical Industry Co., Ltd. under the trade name of Regulus. Hot pressing was performed at a pressure of 0.1 kgf/cm$^2$ and a temperature of 340° C. for 1 minute. At the joint, the sheet materials were satisfactorily joined together. Following the copper foil, the polyimide film was fed to the furnace. The sheet material being processed was exposed to a temperature of 250° C. and a tension of 10 kgf/m. However, the sheet material was satisfactorily processed without suffering from any trouble such as breakage, meandering, or variation in tension.

EFFECTS OF THE INVENTION

According to the present invention, sheet materials are connected in end-to-end relationship by thermocompression bonding using a resin bonding layer as the bonding layer. Thus, even where a subsequent processing step is carried out under severe conditions including a temperature in the range of 200° C. to less than 550° C. and a tension in the range of 0.1 to 50 kgf/cm, the sheet materials can be satisfactorily processed without suffering from breakage, separation, meandering, variation in tension, or the like. Moreover, by connecting sheet materials according to the present invention, they can be connected stably and efficiently, and they can be led to a subsequent step at a constant feed speed.

DEFINITION OF CHARACTERS

Figure 1:
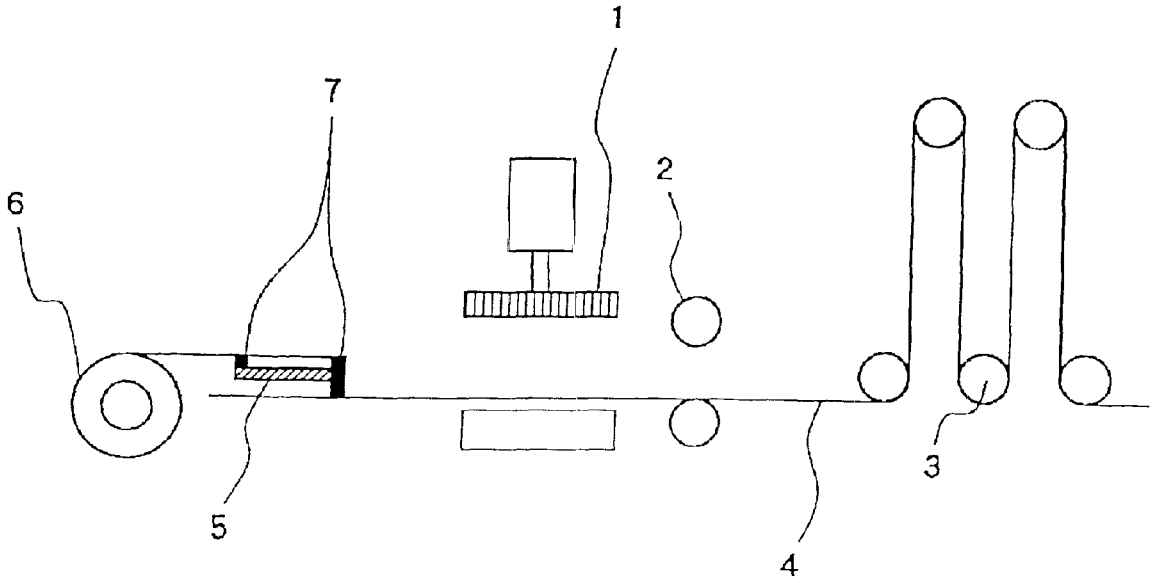
FIG. 1 is a view of one form of apparatus used for carrying out the method for forming a continuous material by connecting sheet materials in accordance with the present invention, illustrating the sheet materials having a resin bonding layer (a thermoplastic polyimide film) interposed therebetween.
Figure 2:
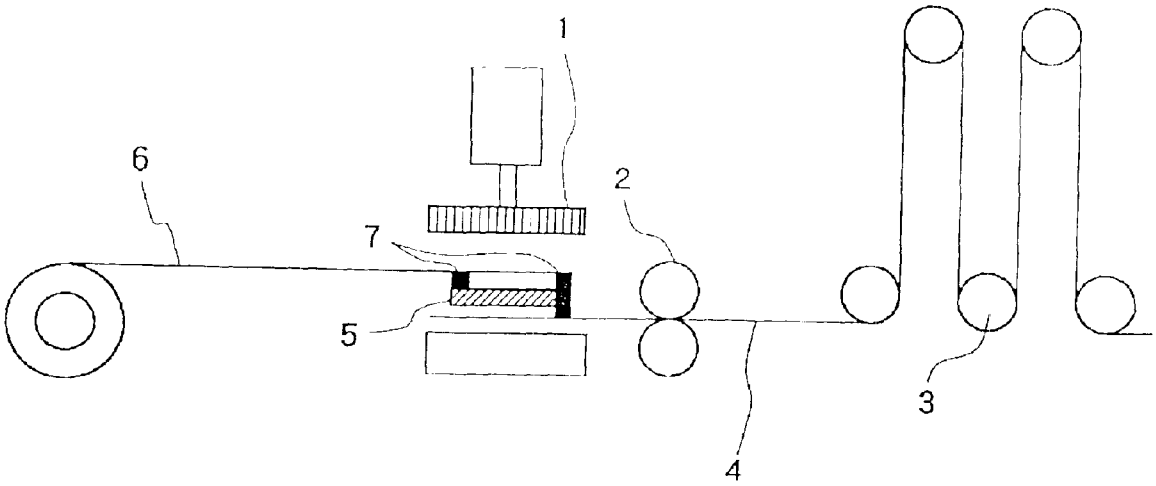
FIG. 2 is a view of one form of apparatus used for carrying out the method for forming a continuous material by connecting sheet materials in accordance with the present invention, illustrating the sheet materials whose joined part has come to a standstill within a hot press.
Figure 3:
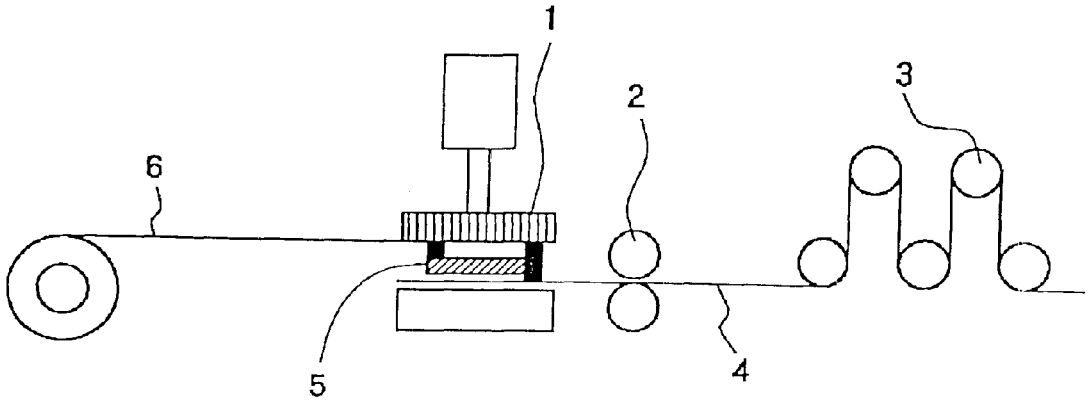
FIG. 3 is a view of one form of apparatus used for carrying out the method for forming a continuous material by connecting sheet materials in accordance with the present invention, illustrating the sheet materials being subjected to thermocompression bonding by operating the hot press.
Figure 4:
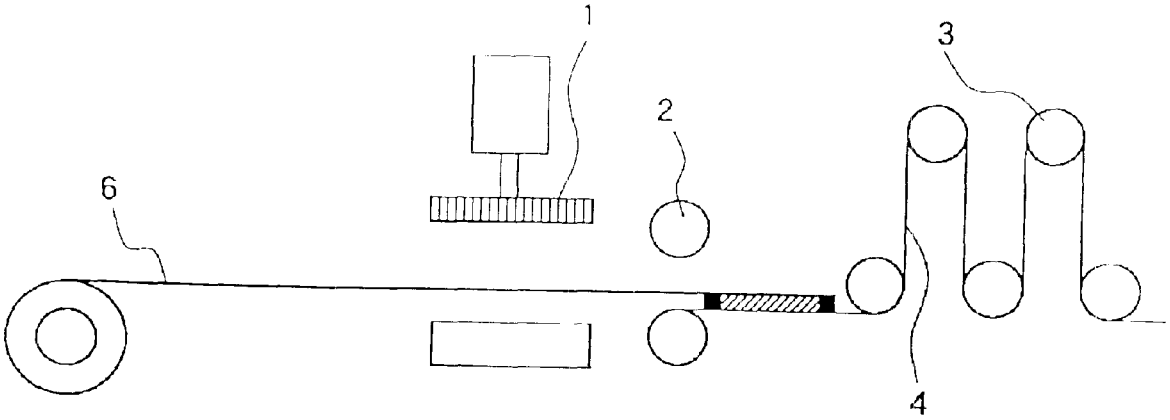
FIG. 4 is a view of one form of apparatus used for carrying out the method for forming a continuous material by connecting sheet materials in accordance with the present invention, illustrating the completely connected sheet materials.

1 Hot press
2 Material locking device
3 Accumulator
4 Sheet material being processed
5 Resin bonding layer
6 Sheet material to be processed
7 Adhesive tape

What is claimed is:

1. A method for forming a continuous material by connecting a preceding sheet material with a succeeding other sheet material in end-to-end relationship while feeding them in their longitudinal direction, said method comprising the steps of:

(1) interposing a resin bonding layer between the trailing edge of the preceding sheet material and the leading edge of the succeeding other sheet material and temporarily joining them together;

(2) after the preceding sheet material and the succeeding other sheet material are fed until the temporarily joined part reaches a hot press, operating a material locking device to lock a part of the preceding sheet material and thereby bring the temporarily joined part to a standstill within the hot press, and also operating an accumulator to keep the teed speed of the preceding sheet material constant on the downstream side thereof;

(3) operating the hot press to effect thermocompression bonding of the temporarily joined part and thereby connect the preceding sheet material 4 with the succeeding other sheet material; and (4) releasing the preceding sheet material from the lock by the material locking device and feeding the connected sheet materials downstream through the accumulator.

2. A method for forming a continuous material by connecting sheet materials as claimed in claim 1 wherein said thermocompression bonding is performed at a temperature in the range of 200° C. to less than 550° C. and a pressure in the range of 0.001 to 50 kgf/cm$^2$.

3. A method for forming a continuous material by connecting sheet materials as claimed in claim 1 wherein the trailing edge of the preceding sheet material and the leading edge of the succeeding other sheet material each have a length of 10 to 1,000 mm.

4. A method for forming a continuous material by connecting sheet materials as claimed in claim 1 wherein the preceding sheet material and the succeeding other sheet material each comprise a metal foil resin film having a thickness of 5 to 500 $\mu$m.

5. A method for forming a continuous material by connecting sheet materials as claimed in claim 1 wherein the resin bonding layer comprises a film of a thermoplastic resin selected from the group consisting of thermoplastic polyimides, aromatic polyetherimides, aromatic polyamide-imides and silicone-modified polyimides.

6. A method for forming a continuous material by connecting sheet materials as claimed in claim 5 wherein the resin bonding layer comprises a thermoplastic polyimide film.

7. A method for forming a continuous material by connecting sheet materials as claimed in claim 1 wherein the resin bonding layer has a thickness of 0.1 to 50 $\mu$m.

8. A method for forming a continuous material by connecting sheet materials as claimed in claim 1 wherein the connected sheet materials are continuously processed at a temperature in the range of 200° C. to less than 550° C. and under a tension in the range of 0.1 to 50 kgf/cm.

* * * * *